US010703609B2

(12) United States Patent
Xu et al.

(10) Patent No.: US 10,703,609 B2
(45) Date of Patent: Jul. 7, 2020

(54) PASSENGER TRANSFERRING DEVICE

(71) Applicant: Otis Elevator Company, Farmington, CT (US)

(72) Inventors: Kaisheng Xu, Guangdong (CN); JiAn Wan, Guangdong (CN); JianGuo Li, ZheJiang (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 16/285,951

(22) Filed: Feb. 26, 2019

(65) Prior Publication Data

US 2019/0263632 A1 Aug. 29, 2019

(30) Foreign Application Priority Data

Feb. 28, 2018 (CN) ..... 2018 1 0166832

(51) Int. Cl.
*B66B 23/12* (2006.01)
*B66B 29/02* (2006.01)

(52) U.S. Cl.
CPC ..... *B66B 23/12* (2013.01); *B66B 29/02* (2013.01)

(58) Field of Classification Search
None
See application file for complete search history.

(56) References Cited

U.S. PATENT DOCUMENTS 5,810,147 A 9/1998 Vanmoor
6,213,278 B1 * 4/2001 Tanigawa ..... B66B 23/12 198/326
6,283,270 B1 9/2001 Robibero et al.
6,978,876 B1 12/2005 Tsukahara et al.
7,264,105 B2 9/2007 Illedits
(Continued)

FOREIGN PATENT DOCUMENTS

CN 102190235 A 9/2011
CN 102556816 B 12/2014
CN 103261082 B 2/2015
(Continued)

OTHER PUBLICATIONS

Aoqun Brush; Escalator Safety Brush; Retrieved from Internet; URL: http://aoqunbrush.com/escalator-brush; 2018; 4 pages.
(Continued)

*Primary Examiner* — Kavel Singh
(74) *Attorney, Agent, or Firm* — Cantor Colburn LLP

(57) ABSTRACT

A passenger conveying device, including: an entrance, an exit, and a plurality of steps disposed between the entrance and the exit. A skirt guard panel is respectively disposed on two sides of the step, and the step is constructed to reciprocally move between the entrance and the exit along a path defined by the skirt guard panel. The step includes a tread, a tread guard panel is attached to each of two sides of tread, and the tread guard panel is located between the tread and the skirt guard panel. The tread guard panel includes two or more protrusions, each protrusion is constructed to protrude with respect to an upper surface of the tread, and a protrusion farther away from the tread has a larger protrusion height. The passenger conveying device of the present invention has the advantages of simple structure, reliable installation, and convenient maintenance.

11 Claims, 7 Drawing Sheets

(56) References Cited

U.S. PATENT DOCUMENTS 9,850,099 B2 12/2017 Hoopes et al.

FOREIGN PATENT DOCUMENTS

| | | | |
|---|---|---|---|
| CN | 103373661 | B | 8/2015 |
| CN | 106379803 | A | 2/2017 |
| GB | 2223731 | A | 4/1990 |
| JP | 5241378 | A | 3/1977 |
| JP | H0359982 | U | 3/1991 |
| JP | 2004292105 | A | 10/2004 |
| JP | 4997866 | B2 | 8/2012 |

OTHER PUBLICATIONS

European Search Report EP 19160108.7, dated Jul. 23, 2019, U321106EP, 9 pages.

* cited by examiner

PASSENGER TRANSFERRING DEVICE

FOREIGN PRIORITY

This application claims priority to Chinese Patent Application No. 201810166832.9, filed Feb. 28, 2018, and all the benefits accruing therefrom under 35 U.S.C. § 119, the contents of which in its entirety are herein incorporated by reference.

TECHNICAL FIELD

The present invention relates to the field of escalator structures, and more specifically to a passenger conveying device having an antipinch structure to prevent a passenger's foot or clothing from being unexpectedly stuck into the gap between the step and the skirt guard panel.

BACKGROUND ART

As is known, many passenger conveying devices have been widely applied in the building field. Typical passenger conveying devices include escalators and elevators. An existing escalator generally includes a plurality of steps of which the relative positions can be changed. Each of the steps includes a roller to move along a guide rail. The plurality of steps are generally connected together by an annularly installed step chain, so as to achieve reciprocating movement between the entrance and exit of the escalator.

In addition, handrails are generally vertically disposed on two sides of the steps, and a skirt guard panel is disposed at a lower part of each handrail. The skirt guard panel is spaced apart from the plurality of steps and treads attached to the steps. Typically, there is a gap between an edge of the tread and the skirt guard panel, and there is also a gap between the step and the skirt guard panel.

However, in use, a user may stand at a position which is too close to the skirt guard panel. In this case, the user's shoes edge, shoelace, skirt hem, sock, or trousers cuff is likely to be stuck into the gap near the skirt guard panel, leading to an unexpected accident. Particularly, such accidents occur more likely at the very moment when a user steps on or leaves an escalator or when there are a larger quantity of persons densely standing on the escalator.

Some solutions have been proposed in the prior art to solve the above problems. For example, in an embodiment shown in FIG. 9, a covering portion 30 is disposed on a tread 10. One end 31 of the covering portion 30 extends out of the tread 10 and is arranged along a skirt guard panel 20 to cover a gap 40 between the tread 10 and the skirt guard panel 20. Similarly, in an embodiment shown in FIG. 10, a gap 40 between a skirt guard panel 20 and a riser 50 is covered by an extending part 61 of a covering portion 60. The purpose of the above designs is to use the covering portion to prevent the shoes or clothing from entering the gap 40. In addition, there are also safe designs such as providing triangular protective equipment or a skirt guard panel safety switch and changing the shape of engagement between an antislip strip and the tread. However, the existing safe design has the disadvantages of inconvenient operation, poor protection effect, and high maintenance costs.

Therefore, it is necessary to provide a novel passenger conveying device and electric drive, which can overcome the defects of the prior art and make the passenger conveying device safer and more comfortable.

SUMMARY OF THE INVENTION

An objective of the present invention is to provide a passenger conveying device having an improved antipinch structure to effectively prevent a passenger's shoes or clothing from being unexpectedly stuck into the gap between the step and the skirt guard panel.

The objective of the present invention is achieved through the following technical solutions:

A passenger conveying device, including: an entrance, an exit, and a plurality of steps disposed between the entrance and the exit, wherein a skirt guard panel is respectively disposed on two sides of the step, and the step is constructed to reciprocally move between the entrance and the exit along a path defined by the skirt guard panel; the step includes a tread, a tread guard panel is attached to each of two sides of the tread, and the tread guard panel is located between the tread and the skirt guard panel; and the tread guard panel includes two or more protrusions, each protrusion is constructed to protrude with respect to an upper surface of the tread, and a protrusion farther away from the tread has a larger protrusion height.

Optionally, the step further includes a riser, a riser guard panel is attached to each of the two sides of the riser, and the riser guard panel is located between the riser and the skirt guard panel.

Optionally, the riser guard panel includes a first edge, a third edge, and a second edge disposed between the first edge and the third edge, a distance from the first edge to the skirt guard panel is greater than that from the third edge to the skirt guard panel, and the second edge is constructed to have a curved contour with smooth transition.

Optionally, top ends of the plurality of protrusions are located on the same straight line, circular arc, elliptic arc, hyperbola, or parabola.

Optionally, shapes of the plurality of protrusions are constructed such that contours of top portions of the protrusions are located on the same straight line, circular arc, elliptic arc, hyperbola, or parabola.

Optionally, the second edge is constructed to have a contour in the shape of a circular arc, an elliptic arc, a hyperbola, or a parabola.

Optionally, the tread guard panel includes a first protrusion, a second protrusion, and a tread guard panel edge, the second protrusion is disposed between the first protrusion and the tread, a straight line connecting top portions of the first protrusion and the second protrusion intersects with an extending line of the tread guard panel edge to form a first included angle, and the first included angle is an acute angle.

Optionally, the first edge and the third edge are disposed parallel to each other, an extending line of the third edge intersects with a tangent of the second edge to form a second included angle, and the second included angle is an acute angle.

Optionally, the tread guard panel and the riser guard panel are constructed as a whole or to be separate.

Optionally, the plurality of steps are connected by a step chain and move between the entrance and the exit along a guide rail by means of rollers.

Optionally, each protrusion protrudes with respect to the upper surface of the tread 110 by 3-9 mm.

Optionally, the step further includes a step frame to which the tread and the riser are attached.

The present invention has the following beneficial effects: the passenger conveying device of the present invention has the advantages of simple structure, reliable installation, and convenient maintenance. The passenger conveying device of the present invention can effectively improve the safety factor and user experience of an escalator.

BRIEF DESCRIPTION OF THE DRAWINGS

The present invention will be described in further detail below with reference to the accompanying drawings and preferred embodiments, but it will be appreciated by those skilled in the art that the accompanying drawings are merely drawn for the purpose of explaining the preferred embodiments, and thus should not be construed as limiting the scope of the present invention. In addition, unless otherwise particularly stated, the accompanying drawings are only intended to conceptually represent the composition or construction of the described subject matter and may include an exaggerated illustration. The drawings are not necessarily drawn to scale.

DETAILED DESCRIPTION

Figure 1:
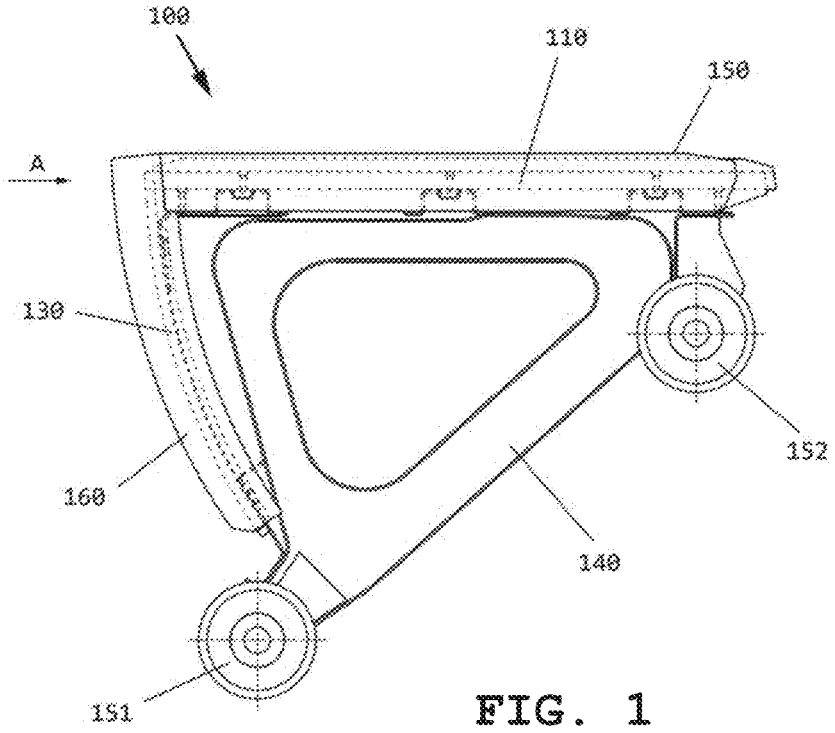
FIG. 1 is a side view of a single step in an embodiment of a passenger conveying device of the present invention.

The preferred embodiments of the present invention will be described in detail below with reference to the accompanying drawings. It will be appreciated by those skilled in the art that these descriptions are only illustrative and exemplary and should not be construed as limiting the scope of the present invention.

Firstly, it should be noted that the orientational terms such as top, bottom, up, and down mentioned herein are defined with respect to directions in the accompanying drawings. They are relative concepts, and therefore may change with different positions and different use states. Therefore, these or other orientational terms should not be construed as limiting terms.

In addition, it should also be noted that for any single technical feature described or implied in the embodiments herein or any single technical feature shown or implied in the accompanying drawings, such technical features (or their equivalents) can still be further combined to obtain other embodiments of the present invention which are not directly mentioned herein.

It should be noted that in different drawings, the same reference numerals indicate the same or substantially the same parts.

A passenger conveying device of the present invention includes: an entrance, an exit, and a plurality of steps disposed between the entrance and the exit. A skirt guard panel is disposed respectively on two sides of each step. Each step is constructed to reciprocally move between the entrance and the exit along a path defined by the guard panels.

Therefore, there is a gap respectively between each step and the skirt guard panel on two sides of the step, allowing the step to move relative to the skirt guard panel.

Optionally, a movable handrail is disposed above each skirt guard panel, for the user to place hands. The handrail is configured to move substantially in the same direction and at the same speed relative to the steps.

Optionally, the movement speed of the handrail relative to the skirt guard panel is set to be slightly greater than the movement speed of each step relative to the skirt guard panel.

FIG. 1 is a side view of a single step in an embodiment of a passenger conveying device of the present invention. The passenger conveying device includes a plurality of steps 100. Each step 100 includes: a tread 110, provided with a tread guard panel 150; a riser 130, provided with a riser guard panel 160; and a step frame 140, attached to the tread 110 and the riser 130.

The tread guard panel 150 is disposed on two sides of the tread 110 and located between the tread 110 and the skirt guard panel 200. The riser guard panel 160 is disposed on two sides of the riser 130 and located between the riser 130 and the skirt guard panel 200. The tread guard panel 150 and the riser guard panel 160 in FIG. 1 completely cover the tread 110 and the riser 130 respectively. Therefore, the contours of the tread 110 and the riser 130 are shown by dashed lines.

In addition, a first roller 151 and a second roller 152 are further attached to the step frame 140, so that the step 100 can move along a guide rail not shown.

The plurality of steps 100 may be connected by an annular step chain not shown and move along the guide rail not shown by means of the rollers.

Optionally, the tread guard panel 150 and the riser guard panel 160 are constructed as a whole or to be separate.

Optionally, the tread guard panel 150 and the riser guard panel 160 are constructed as separate components which can be assembled together.

Figure 2:
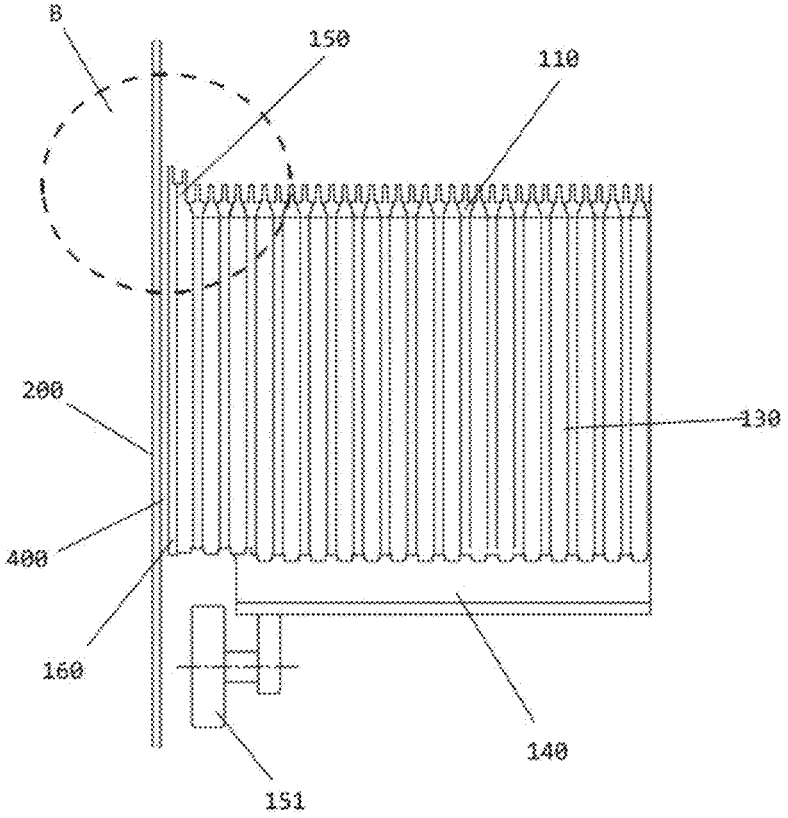
FIG. 2 is a front view of the embodiment shown in FIG. 1 when installed in position.

FIG. 2 is a front view of the embodiment shown in FIG. 1 when installed in position. The tread guard panel 150 and the riser guard panel 160 are respectively disposed at an edge of the tread 110 and an edge of the riser 130. The tread guard panel 150 and the riser guard panel 160 are respectively spaced apart from the skirt guard panel 200. A gap 400 is formed between the tread guard panel 150 and the skirt guard panel 200, and between the riser guard panel 160 and the skirt guard panel 200. As shown in the figure, the tread guard panel 150 protrudes with respect to the tread 110.

Figure 3:
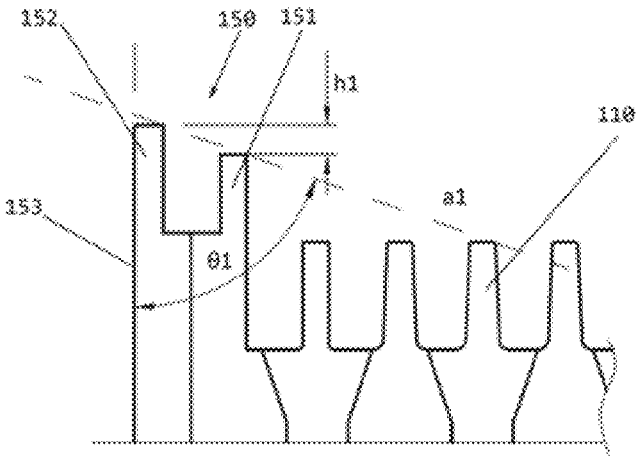
FIG. 3 is an enlarged view of a part B in FIG. 2.

FIG. 3 is an enlarged view of a part B in FIG. 2. The tread guard panel 150 includes two or more protrusions. Each protrusion is constructed to protrude with respect to an upper surface of the tread 110, and a protrusion farther away from the tread 110 has a larger protrusion height. In the embodiment shown in FIG. 3, the tread guard panel 150 includes a first protrusion 151, a second protrusion 152, and a tread guard panel edge 153. The second protrusion 152 is disposed between the first protrusion 151 and the tread 110. The first protrusion 151 and the second protrusion 152 protrude with respect to the upper surface of the tread 110, and a height by which the second protrusion 152 protrudes with respect to the tread 110 is greater than a height by which the first protrusion 151 protrudes with respect to the tread 110. In the embodiment shown in the figure, the height of the second protrusion 152 is greater than that of the first protrusion 151 by h1. A top portion of the first protrusion 151 and a top portion of the second protrusion 152 are located on the same straight line, that is, located on a straight line a1 in the embodiment shown in the figure. Therefore, the straight line a1 connecting the top portion of the first protrusion 151 and the top portion of the second protrusion 152 intersects with an extending line of the tread guard panel edge 153 to form a first included angle θ1.

As shown in the figure, the first included angle θ1 is an acute angle.

In the embodiment shown in the figure, the tread guard panel 150 includes two protrusions. In another embodiment, the tread guard panel 150 may include three or more protrusions, and the protrusions are arranged such that the top portions of the protrusions are located on the same straight line or arc.

Optionally, the plurality of protrusions are arranged such that the top portions of the protrusions are located on the same circular arc, elliptic arc, hyperbola, parabola, or other suitable curve.

In an embodiment of the present invention, the first protrusion 151 and the second protrusion 152 protrude with respect to the upper surface of the tread 110 by 3-9 mm.

In an embodiment of the present invention, the top portions of the first protrusion 151 and the second protrusion 152 are both constructed to be flat. In another embodiment, the top portion of the first protrusion 151 and/or the top portion of the second protrusion 152 is constructed to have an oblique contour, and the oblique contour may extend along the line a1 connecting the top portion of the first protrusion 151 and the top portion of the second protrusion 152.

Optionally, the shapes of the protrusions may be constructed such that top contours of the protrusions are located on the same straight line, circular arc, elliptic arc, hyperbola, parabola, or other suitable curve.

Figure 4:
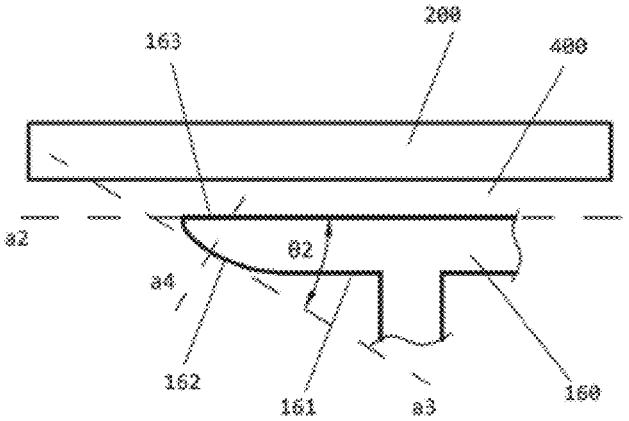
FIG. 4 is a cross-sectional view of a riser guard panel in the embodiment shown in FIG. 1.

FIG. 4 is a cross-sectional view of a riser guard panel in the embodiment shown in FIG. 1. The riser guard panel 160 includes: a first edge 161, a third edge 163, and a second edge 162 disposed between the first edge 161 and the third edge 163. The second edge 162 has a curved contour with smooth transition.

As shown in the figure, the third edge 163 faces toward the skirt guard panel 200, a gap 400 is provided between the third edge 163 and the skirt guard panel 200, and a distance from the first edge 161 to the skirt guard panel 200 is greater than that from the third edge 163 to the skirt guard panel 200.

In addition, in the embodiment shown in the figure, the first edge 161 and the third edge 163 are disposed parallel to each other, and the second edge 162 protrudes away from the skirt guard panel 200. An extending line a2 of the third edge 163 intersects with a tangent a3 of the second edge 162 to form a second included angle θ2. FIG. 4 also shows a vertical line a4 perpendicular to the tangent a3 of the second edge 162.

As shown in the figure, the second included angle θ2 is an acute angle.

Optionally, the first edge 161 and the third edge 163 are constructed to have a contour in the shape of a straight line.

Optionally, the second edge 162 is constructed to have a contour in the shape of a circular arc, an elliptic arc, a hyperbola, a parabola, or other suitable shape.

Figure 5:
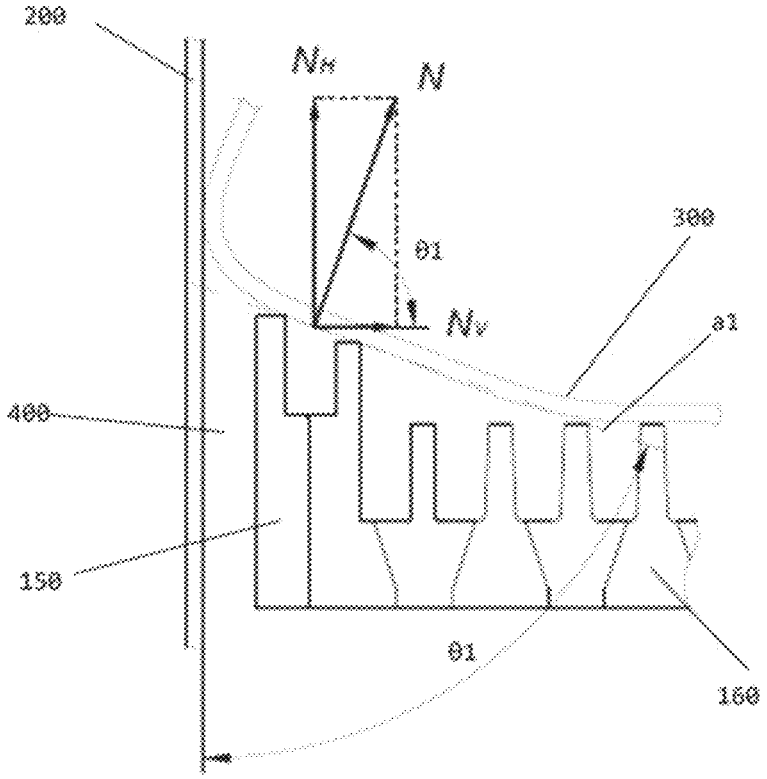
FIG. 5 is a schematic diagram of forces exerted on the embodiment shown in FIG. 3 during operation.

FIG. 5 is a schematic diagram of forces exerted on the embodiment shown in FIG. 3 during operation. When a user takes the passenger conveying device according to the present invention, if the user's shoes 300 are placed at the edge of the tread 110, that is, leans on the skirt guard panel 200, as shown in the figure, the shoes 300 partially lean on the skirt guard panel 200 and partially lean on the tread guard panel 150, and are supported by the first protrusion 151 and the second protrusion 152. In this case, the first protrusion 151 and the second protrusion 152 jointly exert a first supporting force N on the shoes 300. According to the relationship between the heights of the first protrusion 151 and the second protrusion 152, the direction of the first supporting force N is perpendicular to the line a1 connecting the top portions of the first protrusion 151 and the second protrusion 152.

In addition, the first supporting force N may be divided into a vertical component $N_h$ and a horizontal component $N_v$. An angle between the horizontal component $N_v$ and the first supporting force N is equal to the first included angle θ1.

Therefore, when the user' shoes 300 are too close to the skirt guard panel 200, the tread guard panel 150 according to the present invention can exert a horizontal force on the shoes 300 (that is, the horizontal component $N_v$ of the first supporting force N), so that the shoes 300 moves away from the skirt guard panel 200, to effectively prevent the shoes 300 or the user' clothing from unexpectedly entering the gap 400, thus avoiding accidents.

Figure 6A:
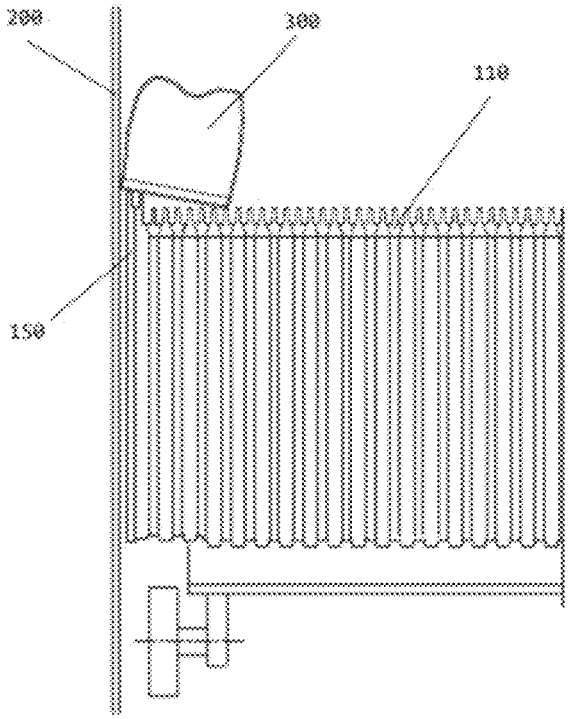
FIG. 6A to FIG. 6C are schematic diagrams illustrating how the embodiment shown in FIG. 3 operates.
Figure 6B:
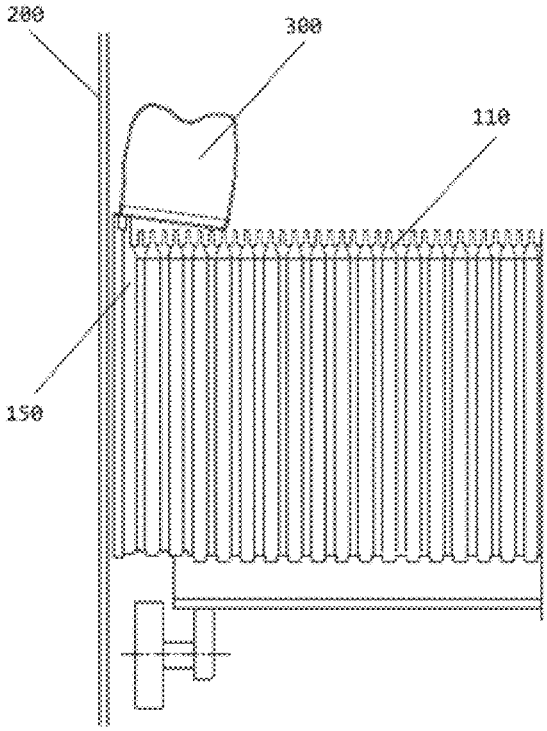
Figure 6C:
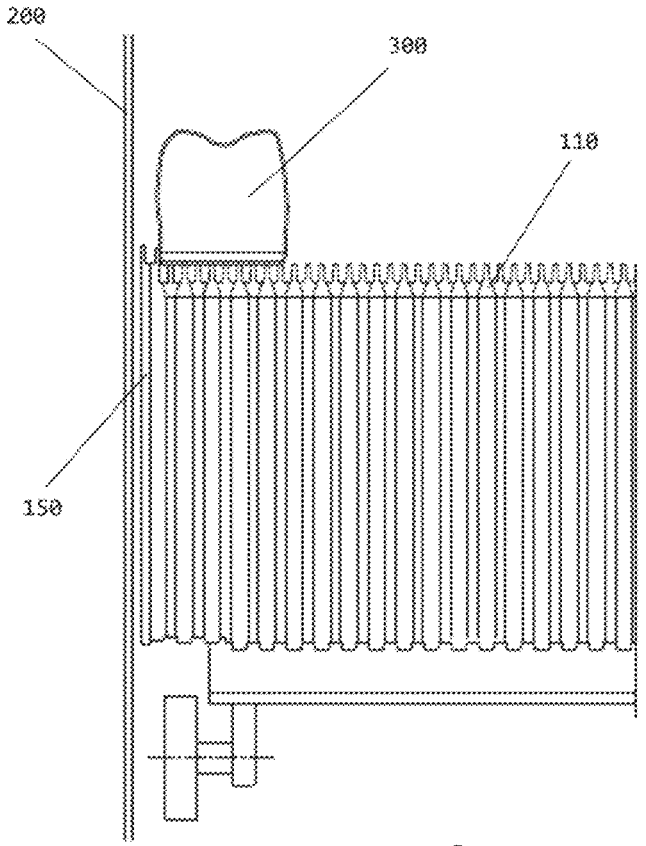

FIG. 6A to FIG. 6C are schematic diagrams illustrating how the embodiment shown in FIG. 3 operates. As shown in FIG. 6A and FIG. 6B, under the action of the tread guard panel 150 according to the present invention, the shoes 300 continuously move away from the skirt guard panel 200. In FIG. 6C, the shoes 300 are finally separated from the tread guard panel 150 and are completely located on the tread 110. In this case, the shoes 300 have already been kept away from the skirt guard panel 200 and the gap 400, thus preventing the shoes 300 or the user' clothing from being unexpectedly stuck into the gap 400.

Figure 7:
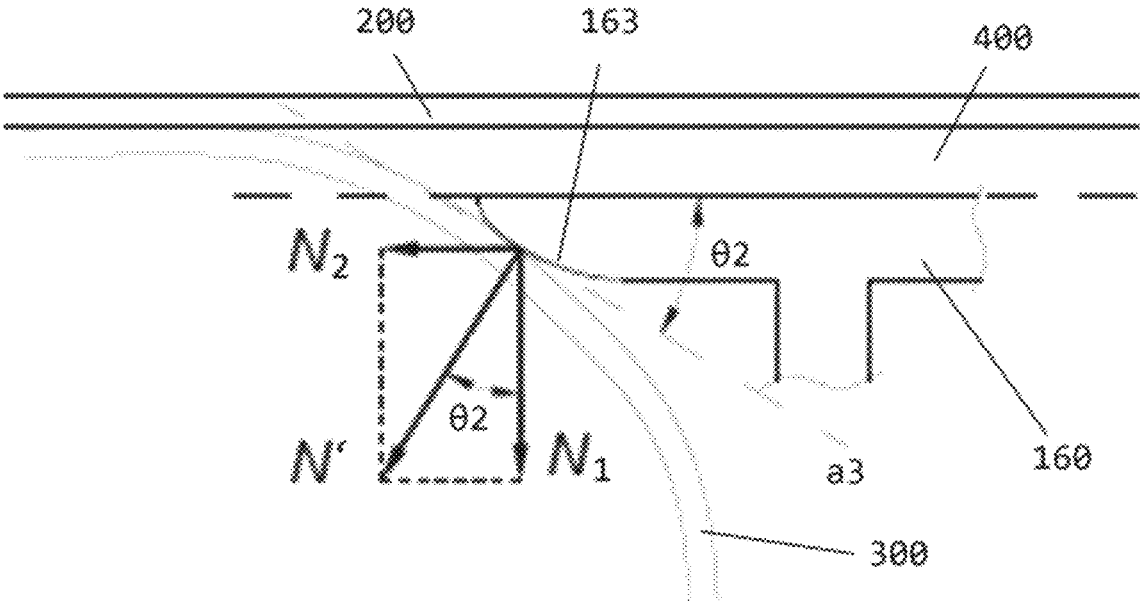
FIG. 7 is a schematic diagram of forces exerted on the embodiment shown in FIG. 4 during operation.

FIG. 7 is a schematic diagram of forces exerted on the embodiment shown in FIG. 4 during operation. When a user takes the passenger conveying device according to the present invention, if the user's shoes 300 are placed at the edge of the riser 130, that is, leans on the skirt guard panel 200, as shown in the figure, the shoes 300 partially lean on the skirt guard panel 200 and partially lean on the riser guard panel 160, and are supported by the second edge 162. In this case, the second edge 162 exerts a second supporting force N' on the shoes 300, According to the shape of the second edge 162, the direction of the second supporting force N' is perpendicular to the tangent a3 of the second edge 162 and is located in the direction of the vertical line a4 in FIG. 4.

In addition, the second supporting force N' may be divided into a first component $N_1$ and a second component $N_2$. An angle between the second component $N_1$ and the second supporting force N' is equal to the second included angle θ2.

Therefore, when the user' shoes 300 are too close to the skirt guard panel 200, the riser guard panel 160 according to the present invention can exert a force on the shoes 300 (that is, the first component $N_1$ of the second supporting force N'), so that the shoes 300 moves away from the skirt guard panel 200, to effectively prevent the shoes 300 or the user' clothing from unexpectedly entering the gap 400, thus avoiding accidents.

Figure 8A:
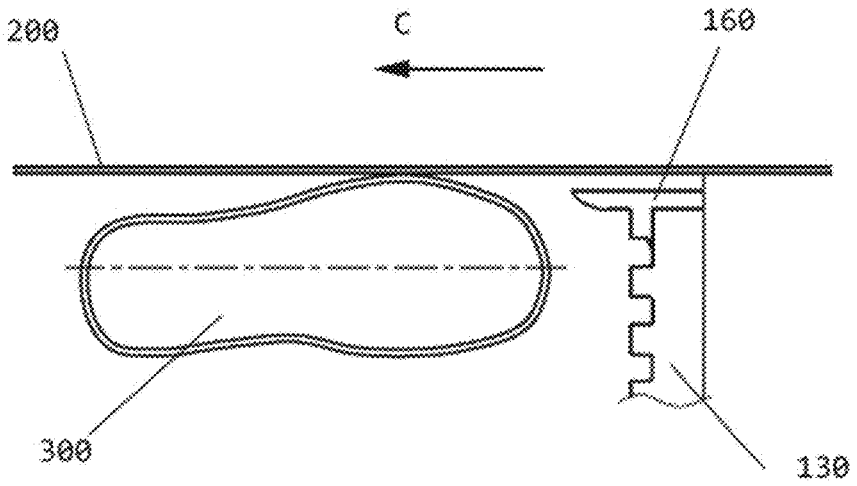
FIG. 8A to FIG. 8C are schematic diagrams illustrating how the embodiment shown in FIG. 4 operates.
Figure 8B:
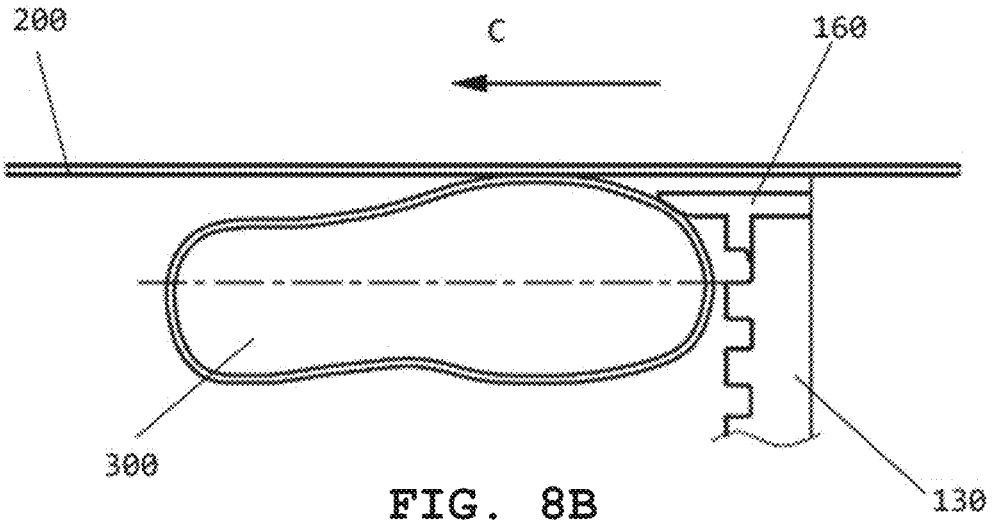
Figure 8C:
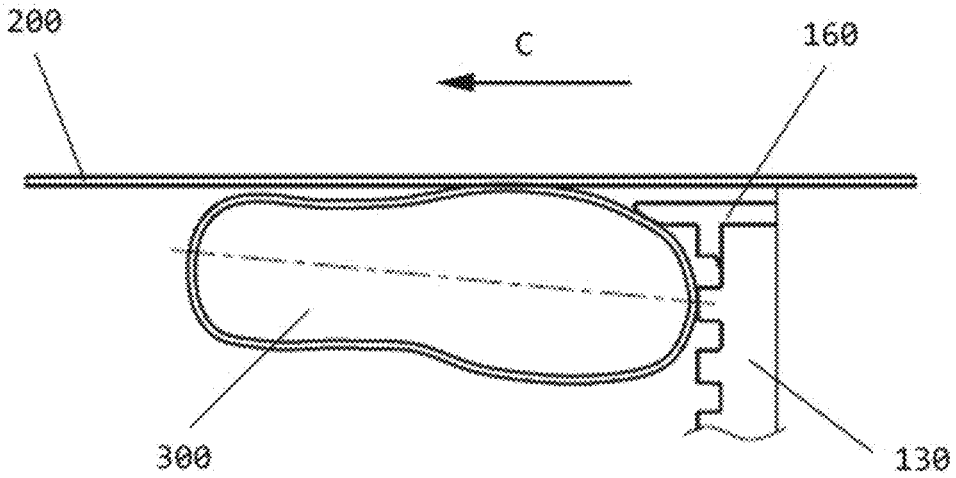
Figure 9:
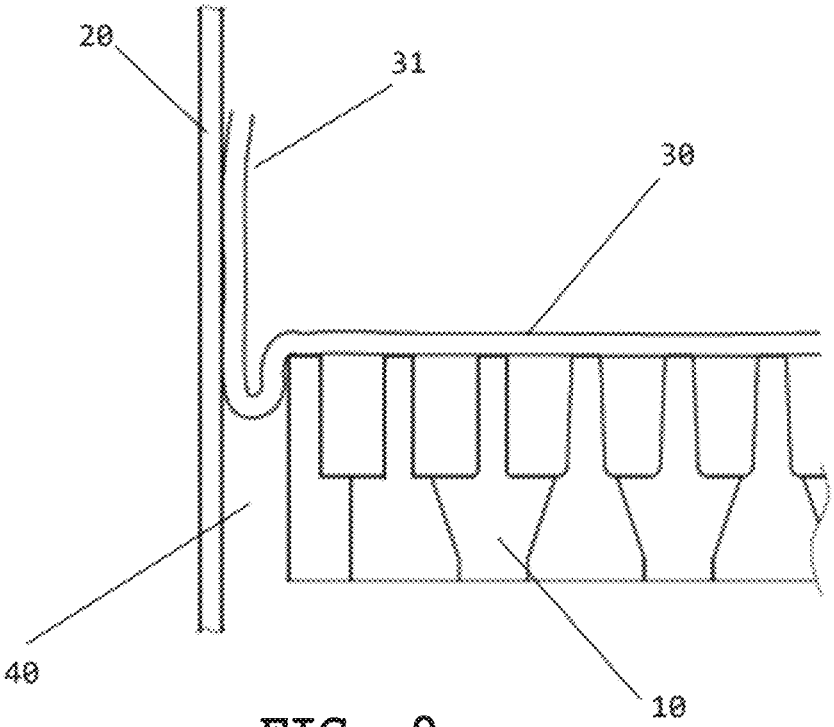
FIG. 9 is a schematic diagram of an antipinch means at a tread edge in the prior art.
Figure 10:
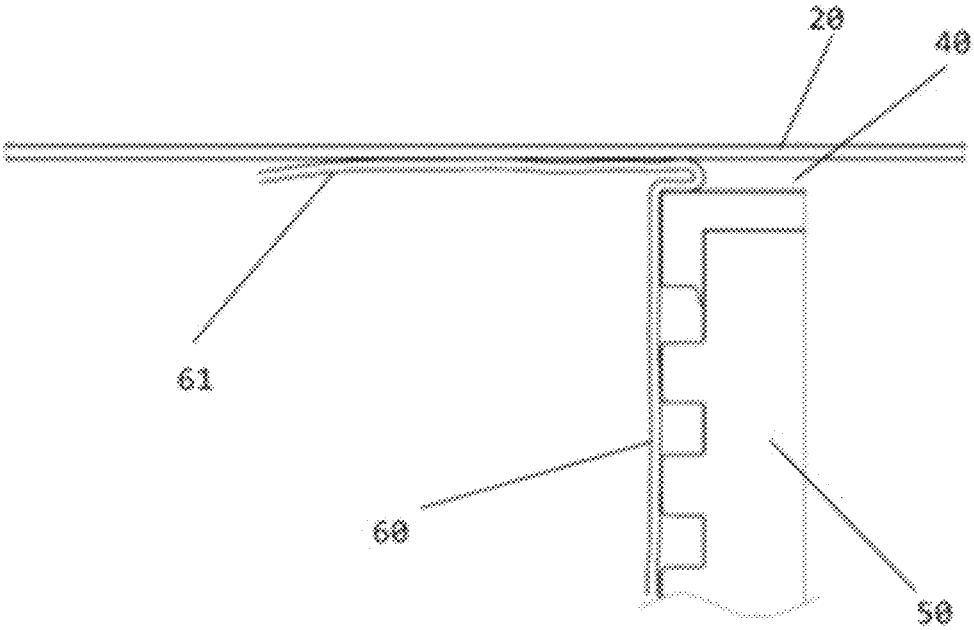
FIG. 10 is a schematic diagram of an antipinch means at a riser edge in the prior art.

FIG. 8A to FIG. 8C are schematic diagrams illustrating how the embodiment shown in FIG. 4 operates. As shown in the figures, under the action of the riser guard panel 160 according to the present invention, the shoes 300 continuously move away from the skirt guard panel 200. Therefore, the shoes 300 is effectively kept away from the gap 400, thus preventing the shoes 300 or the user' clothing from being unexpectedly stuck into the gap 400.

In use, under the joint action of the tread guard panel 150 and the riser guard panel 160 according to the present invention, the user' shoes, shoelace, or other clothing is prevented from being unexpectedly stuck into the gap 400 between the step 100 and the skirt guard panel 200, thus effectively increasing the safety when the user takes the passenger conveying device, and improving user experience.

The passenger conveying device of the present invention includes an escalator, an elevator, a moving sidewalk, and so on.

This specification discloses the present invention with reference to the accompanying drawings, and also enables those skilled in the art to implement the present invention, including the manufacture and use of any device or system, the selection of suitable materials, and the use of any combination of methods. The scope of the present invention is defined by the disclosed technical solutions, and includes other examples that are figured out by those skilled in the art. As long as such other examples include structural elements that are not different from the literal language of the request protection, or such other examples include equivalent structural elements that substantially are not different from the literal language of the disclosed technical solutions, such other examples should be considered to be within the protection scope defined by the technical solutions disclosed by the present invention.

What is claimed is:

1. A passenger conveying device, comprising:

an entrance, an exit, and a plurality of steps disposed between the entrance and the exit, wherein a skirt guard panel is respectively disposed on two sides of the step, and the step is constructed to reciprocally move between the entrance and the exit along a path defined by the skirt guard panel;

the step comprises a tread, a tread guard panel is attached to each of two sides of the tread, and the tread guard panel is located between the tread and the skirt guard panel; and the tread guard panel comprises two or more protrusions, each protrusion is constructed to protrude with respect to an upper surface of the tread, and a protrusion farther away from the tread has a larger protrusion height, wherein the step further comprises a riser, a riser guard panel is attached to each of the two sides of the riser, and the riser guard panel is located between the riser and the skirt guard panel;

wherein the riser guard panel comprises a first edge, a third edge, and a second edge disposed between the first edge and the third edge, a distance from the first edge to the skirt guard panel is greater than that from the third edge to the skirt guard panel, and the second edge is constructed to have a curved contour with smooth transition.

2. The passenger conveying device according to claim 1, wherein top ends of the two or more protrusions are located on the same straight line, circular arc, elliptic arc, hyperbola, or parabola.

3. The passenger conveying device according to claim 2, wherein shapes of the plurality of protrusions are constructed such that contours of top portions of the protrusions are located on the same straight line, circular arc, elliptic arc, hyperbola, or parabola.

4. The passenger conveying device according to claim 1, wherein the second edge is constructed to have a contour in the shape of a circular arc, an elliptic arc, a hyperbola, or a parabola.

5. The passenger conveying device according to claim 1, wherein the tread guard panel comprises a first protrusion, a second protrusion, and a tread guard panel edge, the second protrusion is disposed between the first protrusion and the tread, a straight line connecting top portions of the first protrusion and the second protrusion intersects with an extending line of the tread guard panel edge to form a first included angle, and the first included angle is an acute angle.

6. The passenger conveying device according to claim 1, wherein the first edge and the third edge are disposed parallel to each other, an extending line of the third edge intersects with a tangent of the second edge to form a second included angle, and the second included angle is an acute angle.

7. The passenger conveying device according to claim 1, wherein the tread guard panel and the riser guard panel are constructed as a whole or to be separate.

8. The passenger conveying device according to claim 1, wherein the plurality of steps are connected by a step chain and move between the entrance and the exit along a guide rail by means of rollers.

9. The passenger conveying device according to claim 1, wherein each protrusion protrudes with respect to the upper surface of the tread by 3-9 mm.

10. The passenger conveying device according to claim 1, wherein the step further comprises a step frame to which the tread and the riser are attached.

11. The passenger conveying device according to claim 1, wherein the two or more protrusions extend parallel to each other along a majority of the tread.

* * * * *